United States Patent [19]

Spinner

[11] 4,440,464

[45] Apr. 3, 1984

[54] COAXIAL HF PLUG CONNECTOR HAVING ALTERNATE CONNECTING MEANS

[76] Inventor: Georg Spinner, Am Eichberg 12, D-8152 Feldkirchen-Westerham 1, Fed. Rep. of Germany

[21] Appl. No.: 272,056

[22] Filed: Jun. 9, 1981

[30] Foreign Application Priority Data

Jun. 12, 1980 [DE] Fed. Rep. of Germany ..... 3022102

[51] Int. Cl.[3] ..... H01R 13/625

[52] U.S. Cl. ..... 339/33; 339/89 C; 339/90 C

[58] Field of Search ..... 339/32 R, 32 M, 33, 339/89 R, 89 C, 89 M, 90 R, 90 C, 90 F

[56] References Cited

U.S. PATENT DOCUMENTS

| | | | |
|---|---|---|---|
| 2,961,630 | 11/1960 | Duncan | 339/90 R |
| 3,049,690 | 8/1962 | Sparber | 339/90 C |
| 3,364,455 | 1/1968 | Nodfelt | 339/90 R |
| 4,239,325 | 12/1980 | Tyson | 339/89 M |
| 4,285,564 | 8/1981 | Spinner | 339/89 C |
| 4,340,269 | 7/1982 | McGeary | 339/90 C |

FOREIGN PATENT DOCUMENTS

| | | | |
|---|---|---|---|
| 60890 | 2/1955 | France | 339/90 R |
| 305681 | 11/1968 | Sweden | 339/90 R |

*Primary Examiner*—John McQuade
*Assistant Examiner*—Gary F. Paumen
*Attorney, Agent, or Firm*—Ostrolenk, Faber, Gerb & Soffen

[57] ABSTRACT

The present invention relates to a coaxial high frequency plug connector which consists of a coupler and a plug in which the coupler is provided with external screw threads and bayonet paths which intersect the screw threads and the plug is provided with either corresponding internal threads or corresponding interlocking bayonet projections for the bayonet paths. By this means, alternate methods of connection may be utilized using the screw thread portions for interengagement by screw threading and using the bayonet projections and bayonet paths for interengagement by bayonet type mounting.

5 Claims, 3 Drawing Figures

COAXIAL HF PLUG CONNECTOR HAVING ALTERNATE CONNECTING MEANS

The present invention relates to a coaxial HF plug-connector consisting of coupler and plug. Such plug connectors are standardized in different embodiments for cables, pipeline connections and housings so that each of the standardized couplers fits a standarized plug of corresponding dimensions, provided that there are a coupler and plug of the same connector system several of which are in their turn standardized. A connection of plugs of the one system with couplers of another system was heretofore not possible. However, it is frequently necessary, for instance for measurement purposes, to connect bayonet cable plugs to housing couplers which have a thread system.

SUMMARY OF THE INVENTION

The object of the invention therefore is in general to make plug and coupler of a connector system with thread connection compatible with a connector system with bayonet connection.

The coaxial HF plug connector of the present invention comprises a coupler and a plug. The coupler is provided with external screw threads and bayonet paths and the plug is provided with corresponding internal screw threads and corresponding interlock bayonet projections for the bayonet paths.

If the plug is provided both with inner thread and also with interlock projections, measures must be taken in order to be able to push the interlock projections outward preferably against spring force so that it is possible to screw onto an externally threaded coupler. Such a relatively high expense will be advisable only for special cases. In general, the plug connector of the present invention is thus characterized by the fact that the externally threaded coupler has bayonet paths which extend at least in part through the external threads and into which the interlock projections of the connecting sleeve of the bayonet plug can be inserted. Such an arrangement is advisable for instance in the event of development as housing coupler since then, for instance, a measurement line can be rapidly connected via a bayonet, attachment when in operation a line with screw attachment is connected. The invention is, however, not limited to housing couplers and can be used in the same way also for cable couplers or other types of plug connectors.

Thus, in accordance with the present invention, the paths for receiving the bayonet projections pass through the external threads (and are cut radially deeper than the threads) of the coupler thereby providing alternate coupling means. Each of the bayonet receiving paths is provided with a section which extends obliquely to the axis of the coupler connecting with a section which extends peripherally and circumferentially of the coupler and connects, in turn, with an extension which is a detent section extending parallel to the axis of the coupler.

BRIEF DESCRIPTION OF THE DRAWINGS

One embodiment of the invention will be described below with reference to the drawing, in which.

DESCRIPTION OF THE PREFERRED ENBODIMENTS

Figure 1:
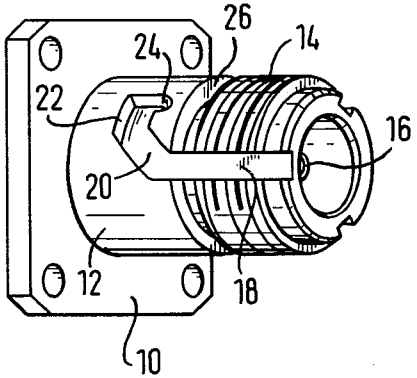
FIG. 1 is a perspective view of a housing coupler for both screw and bayonet connection developed in accordance with the invention.

The housing coupler of FIG. 1 has a flange 10 which can be attached to the housing and an outer-conductor sleeve 12 borne by it which bears a standardized external screw thread 14 which terminates at the milled section 26 which defines the end of the screw thread. The inner-conductor receptacle 16 is inserted in insulated manner into the outer-conductor sleeve 12.

Within the outer-conductor sleeve there are cut, 120° apart from each other, bayonet paths which consist of an axial section 18 which passes through the screw thread 14, an obliquely extending section 20 below the screw thread, a section 22 extending in circumferential direction, and a backward-extending detent section 24. Between the screw thread 14 and the rear smooth sleeve section of the outer-conductor sleeve 12 there is arranged a milling 26.

Figure 2:
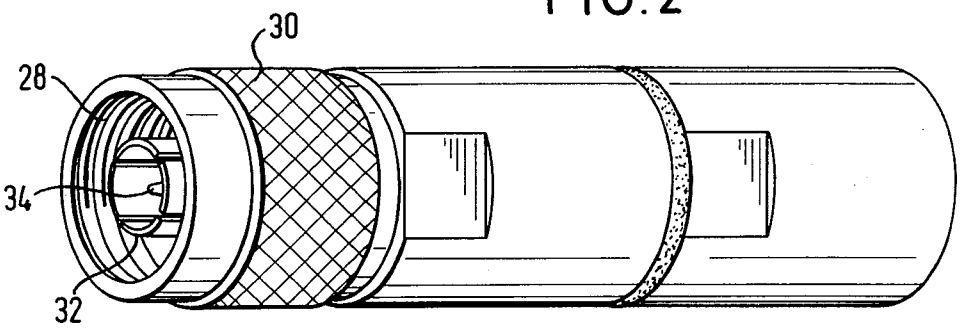
FIG. 2 is a perspective view of a cable plug with screw connection which can be connected to the coupler of FIG. 1.
Figure 3:
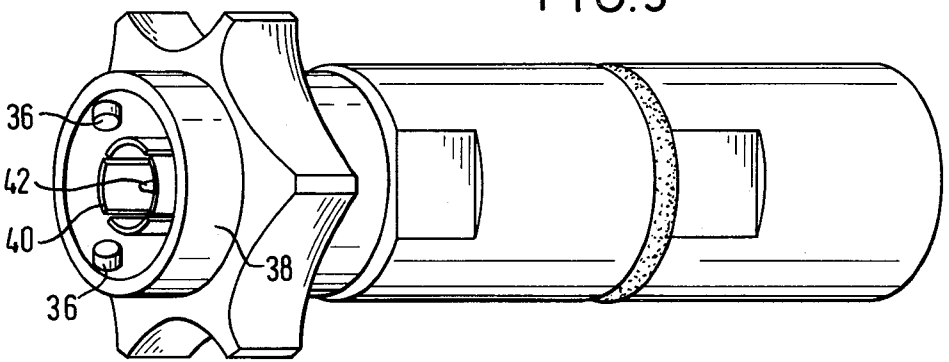
FIG. 3 is a perspective view of a cable plug with bayonet connection which can also be connected to the coupler of FIG. 1.

To this housing coupler of FIG. 1 either a cable plug with screw connection in accordance with FIG. 2 or a cable plug with bayonet connection in accordance with FIG. 3 can be connected. In this case the internal thread 28 of the cap nut 30 is screwed onto the external thread 14 of the coupler, the outer-conductor contact bushing 32 of the plug being inserted into the outer-conductor sleeve 12 and the inner-conductor pin 34 being inserted into the inner-conductor receptacle 16.

When using the bayonet cable plug of FIG. 3, the interlock projections 36 of the connector sleeve 38 slide in the bayonet paths 18, 20, 22, 24, the contacting being effected via outer-conductor contact sleeve 40 and inner-conductor plug pin 42.

In accordance with the embodiment which has been shown by way of example the coupler is developed as a housing coupler, but it could also be developed as a cable coupler, pipeline coupler or the like. Such a coupler, instead of cooperating with cable plugs in accordance with FIGS. 2 and 3 could also cooperate with housing plugs or pipeline plugs which are developed either with screw thread or bayonet lock.

I claim:

1. A coaxial HF plug connector including a coupler and a plug, characterized by the fact that the coupler includes a sleeve which is provided with external screw threads and bayonet paths, said bayonet paths extending at least in part through the external screw threads whereby said coupler may accommodate a plug having either internal threads or bayonet projections.

2. A plug connector according to claim 1, characterized by the fact that said bayonet paths extend in a direction substantially parallel to the axis of said connector.

3. A plug connector according to claim 2, characterized by the fact that the said bayonet paths each have a section which extends obliquely to the axis of the coupler and which connects with a section which extends peripherally and circumferentially of the coupler which in turn connects with an extension which is an axial detent section extending parallel to the axis of the coupler; said connector having a rear unthreaded portion between an end thereof and said external screw threads;

said peripheral and axial detent portion of said bayonet paths being located in said rear unthreaded portion of said connector.

4. A plug connector according to claim 8 characterized by the fact that the bayonet paths are cut radially deeper than said external screw threads.

5. A plug connector according to claim 4, characterized by the fact that between the external screw threads and the unthreaded section of said coupler there is provided a milling the base of which is closer to the axis of the coupler than the screw threads but closer to the periphery of the coupler than the base of the bayonet paths.

* * * * *